United States Patent [19]

Augst

[11] Patent Number: 4,854,815

[45] Date of Patent: Aug. 8, 1989

[54] APPARATUS FOR FEEDING A PACKAGING MACHINE WITH CARDBOARD CUT PIECES STORED IN STACKS

[75] Inventor: Herbert Augst, Duesseldorf, Fed. Rep. of Germany

[73] Assignee: Benz & Hilgers GmbH, Duesseldorf, Fed. Rep. of Germany

[21] Appl. No.: 120,898

[22] Filed: Nov. 16, 1987

[30] Foreign Application Priority Data

Nov. 17, 1986 [DE] Fed. Rep. of Germany ..... 3638806

[51] Int. Cl.[4] ..... B65G 57/06

[52] U.S. Cl. ..... 414/788.4; 271/157; 271/165; 414/792.9; 414/793.4; 414/795.8

[58] Field of Search ..... 414/32, 33, 37, 52, 414/71, 112, 114, 115, 118, 786; 271/3.1, 157, 165

[56] References Cited

U.S. PATENT DOCUMENTS

| | | | |
|---|---|---|---|
| 3,591,018 | 7/1971 | Nalbach | 271/3.1 X |
| 3,908,836 | 9/1975 | Ikeda | 414/32 |
| 4,030,528 | 6/1977 | Horning | 414/33 X |
| 4,364,549 | 12/1982 | Komossa et al. | 414/32 X |
| 4,618,054 | 10/1986 | Muller | 271/157 X |
| 4,662,624 | 5/1987 | Focke | 414/115 X |
| 4,696,615 | 9/1987 | Ettischer et al. | 414/32 X |
| 4,700,941 | 10/1987 | Shill | 271/157 X |

FOREIGN PATENT DOCUMENTS

| | | | |
|---|---|---|---|
| 348441 | 6/1978 | Austria . | |
| 3150190 | 6/1983 | Fed. Rep. of Germany . | |
| 3514487 | 10/1986 | Fed. Rep. of Germany | 414/114 |
| 2047663 | 12/1980 | United Kingdom | 271/3.1 |

*Primary Examiner*—Frank E. Werner
*Assistant Examiner*—Janice Krizek
*Attorney, Agent, or Firm*—Klein & Vibber

[57] ABSTRACT

The invention relates to a process and apparatus for feeding a stack delivery unit of a packaging machine, e.g. a cartoning machine, with cardboard carton cut pieces or the like stored in stacks, whereby the cartons are first loaded onto a first supply stack and are further transferred to a second supply stack with the assistance of a stack clamp of a drive chassis, whereby the partial stacks are each loaded in succession into the supply stacks and the stack delivery unit of the packaging machine. The transport inside the supply stack results with the assistance of contrarotating driven conveyors in which the partial stacks are held a certain distance from one another.

1 Claim, 2 Drawing Sheets

APPARATUS FOR FEEDING A PACKAGING MACHINE WITH CARDBOARD CUT PIECES STORED IN STACKS

FIELD OF THE INVENTION

The invention relates to a process and apparatus for feeding a stack delivery unit of a packaging machine, e.g. a cartoning machine, with stacks of cardboard cut pieces or the like.

DESCRIPTION OF THE PRIOR ART

During stack delivery of a packaging machine, e.g. a cartoning machine, individual cardboard cut pieces are held by the grappling irons of a holding means. The lowest cardboard piece is removed with the assistance of a pneumatic suction device and fed via a transport means, e.g. a pin feed wheel, where the products to be filled into the now folded carton are placed therein and the carton is subsequently closed and, if necessary, sealed. The storage of the cardboard pieces on the grappling irons of the holding device are such that it is possible to store only a small number of cardboard pieces, because otherwise it would not be possible to perform a faultless removal of the lowest cardboard piece. Thus a service person must refill the cardboard pieces relatively frequently. This is especially true where a number of cartoning machines are series-connected and are all serviced by the same service person. Faultless servicing of the packaging machine is, therefore, no longer guaranteed, resulting in interruptions and the consequential delays in production.

Thus the invention addresses the problem of proposing a process which would assist in guaranteeing the faultless feeding to packaging machines of cardboard pieces or the like even with simultaneous servicing of numerous series-connected packaging machines. An additional purpose is the creation of a corresponding apparatus for performance of the process.

SUMMARY OF THE INVENTION

The invention inventively offers a solution to the process problem in that cartons or the like are loaded in succession, either individually or in bunches, as partial stacks into a first supply stack and the partial stacks are stepwise transferred to a second supply stack located near the area of the stack delivery unit of the packaging machine and are transferred as partial stacks from this second stack to the stack delivery unit. With the assistance of the inventive process it is possible to initially feed the first supply stack with partial stacks which are then removed from and separately placed onto the second supply stack where they are subsequently fed to the stack delivery unit of the packaging machine.

For practical purposes the partial stacks loaded into the first supply stack and the partial stacks transferred from the second supply stack are moved in opposing directions in cyclical synchronization with the packaging machine. This assures the automatic feeding of the packaging machine with cardboard pieces or the like.

The inventive apparatus for loading a packaging machine is comprised of a first partial stack receiving stack station and a second partial stack receiving stack station with a transport means on one side connecting both stack stations.

In a practical embodiment of the invention, each stack station has a conveyor with contrarotating (oppositely directed) drives. Thus, the first conveyor can be arranged laterally next to the packaging machine on a mobile truck and the second conveyor near the area of the packaging machine.

It has been shown to be especially beneficial if a mobile stack clamp of the drive chassis making up the transport means is arranged on the first conveyor on the turned away end of the truck and a lowering clamp is arranged on the second conveyor opposite the end where the drive chassis is situated.

BRIEF DESCRIPTION OF THE DRAWING

A preferred embodiment of the invention is shown in the drawings and is explained fully in the following detailed specification.

DETAILED DESCRIPTION

Figure 1:
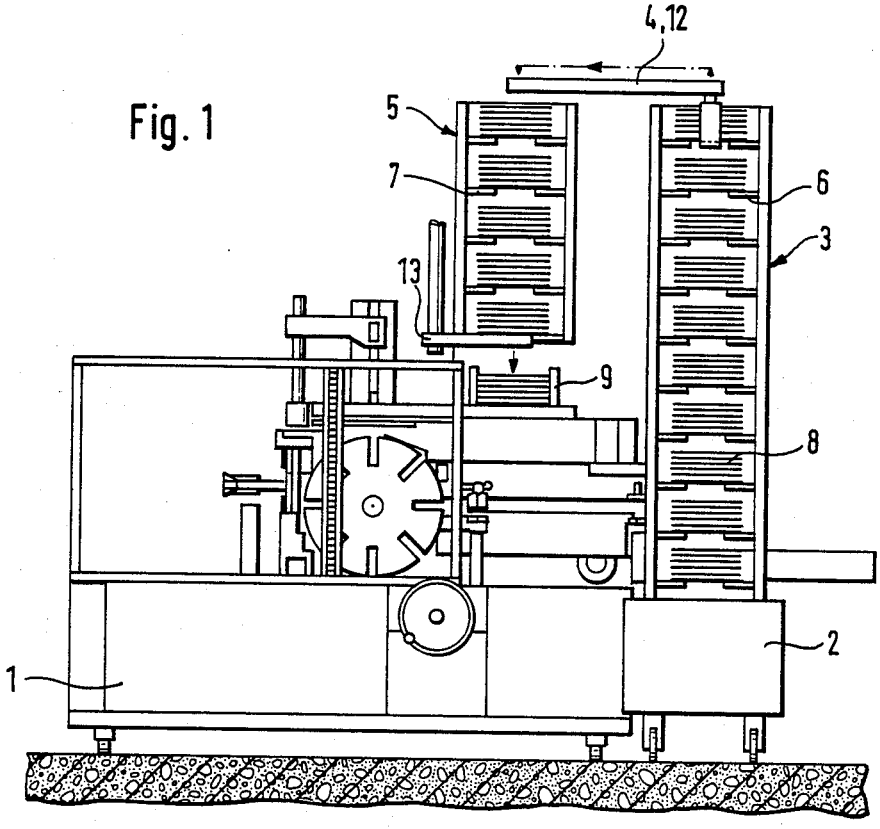
FIG. 1: A schematic representation of the packaging machine with the inventively constructed feeding apparatus.
Figure 2:
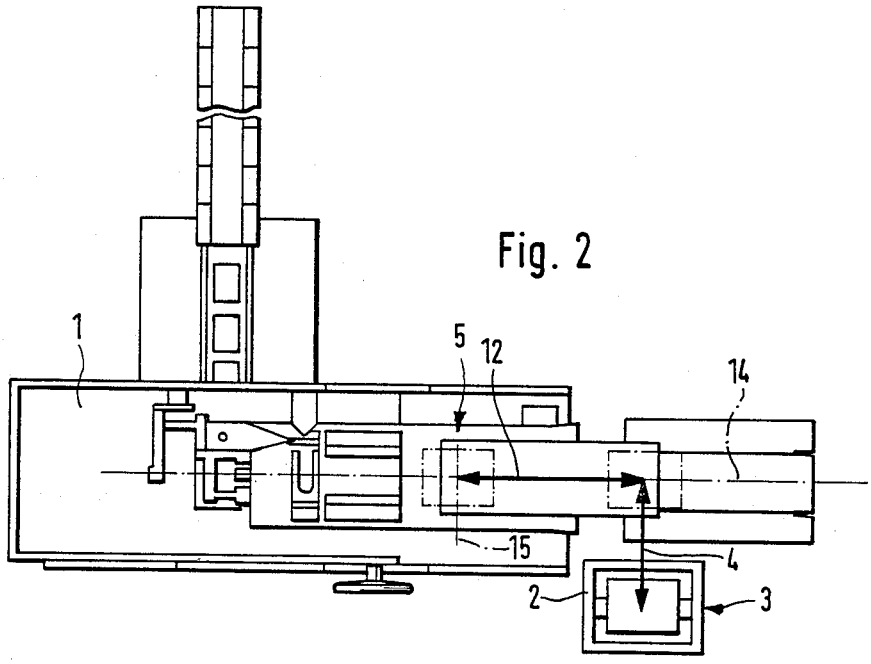
FIG. 2: A top view of the packaging machine and feeding apparatus corresponding to FIG. 1.
Figure 3:
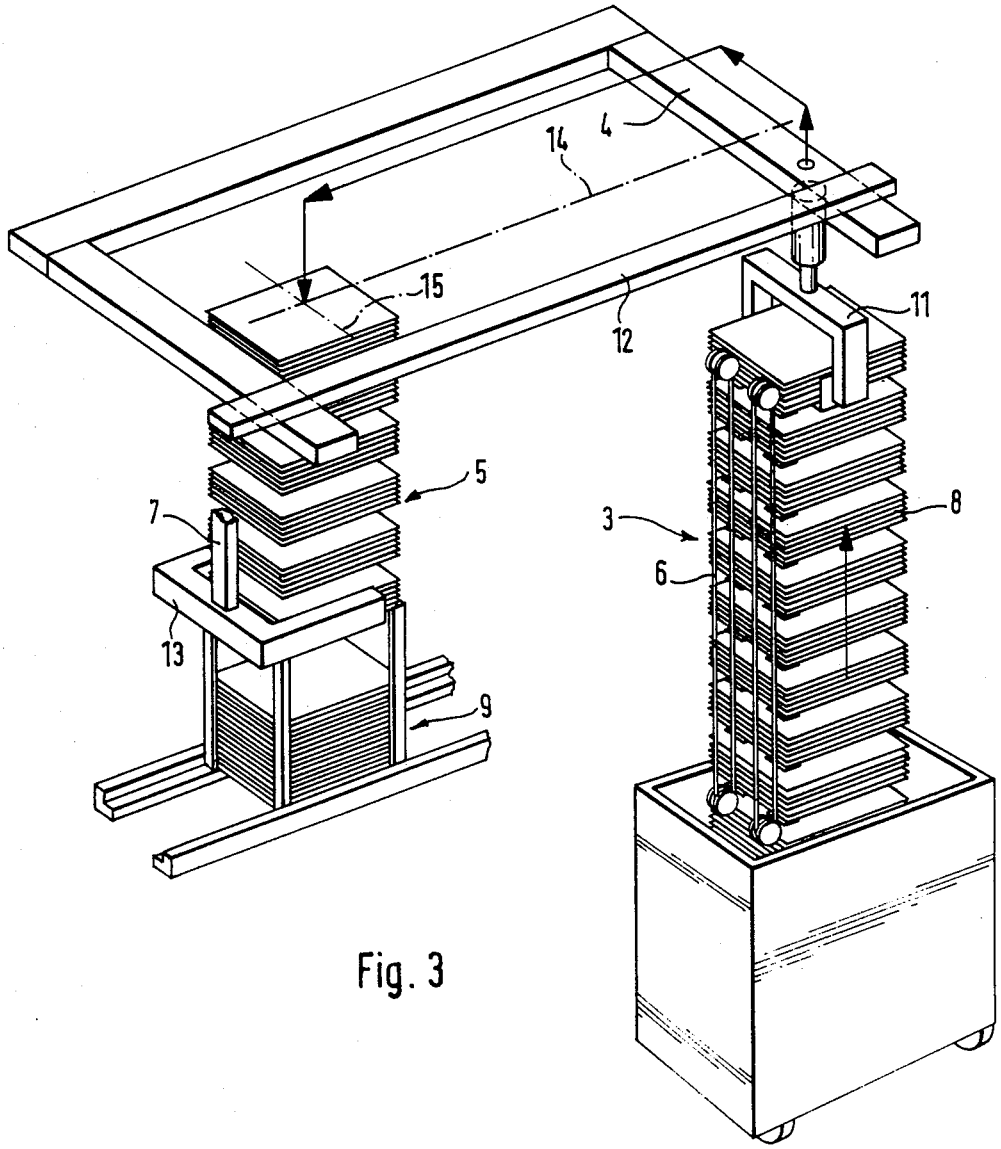
FIG. 3: The feeding apparatus in perspective view in enlarged scale over against FIG. 1.

As can be seen from FIGS. 1 and 2, a first stack station 3 is arranged on a mobile truck 2 lateral to the packaging machine 1 and is connected at its upper end via a drive chassis 4 with a second stack station 5. The first stack station 3 as well as the second stack station 5 each have a conveyor 6 and 7 into which partial stacks of cardboard cut pieces can be loaded. The second stack station 5 is located above a stack delivery unit 9 into which is positioned each packet of cardboard cut pieces which are next in use. With the assistance of the drive chassis 4 it is possible, as is described in more detail below, to remove partial stacks 8 from the first stack station 3 and transport them to the second stack station 5.

The operation of the feeding apparatus is as follows: The first conveyor 6 in the supply stack 3 switches upwards and the second conveyor 7 in the supply stack 5 switches downwards.

Before commencement of production the following occurs: First the first five partial stacks 8 are loaded into the conveyor 6 of the supply stack 3. Afterwards, the conveyor is switched upwards five times in a step-by-step manner via a control means, which is not shown, so that the partial stacks 8 are also moved in an upward direction. Subsequently, the next five partial stacks can be loaded and the stack feeding for conveyor 7 of the supply stack 5 can be switched to automatic feeding. A stack clamp 11 is connected to the drive chassis 4 with which the first partial stack 8 facing said clamp can be lifted off the conveyor 6 of the first stack station. The stack clamp 11 moves via the transverse drive chassis 4 up to the point of alignment 14 with the second supply stack 5. Subsequently, a second longitudinal drive chassis 12 is put into operation and the stack clamp 11 moves from the supply stack 3 to the center 15 of the second supply stack 5. The clamp is then lowered and the first partial stack 8 is transferred to the second stack station 5. After opening the stack clamp 11 the conveyor 7 switches downwards by one cycle and the stack clamp 11 returns to its initial position at the supply stack 3. The operation time can be formulated to be approximately 60 seconds in duration. During the drive chassis movement, the conveyor 6 of the first supply stack 3 switches upwards by one cycle. The process repeats itself until the supply stack 5 is filled, whereupon the machine shuts off.

If the packaging machine, meaning the cartoning machine, is switched on for production, then the automatic supply feed is simultaneously switched on. For example, if the machine stack in the stack delivery unit 9 has been diminished by about 150 mm after approximately 4 minutes operation time, then the start signal for a lowering clamp 13 can be given via a light barrier. At the same time the drive for the conveyor 7 receives a start signal such that the conveyor moves downwards by one cycle. The lowering clamp 13 then delivers the partial stack into the stack delivery unit 9 subsequently moving upwards where the clamp is again closed.

When the conveyor 7 of the supply stack 5 has completed the downward cycle, the stack clamp 11 of the drive chassis 4 receives a start signal and moves a partial stack from the conveyor 6 to conveyor 7 of the supply stack 5. This process is automatically repeated every 4 to 5 minutes. For example, the conveyor 6 will have a running time of approximately 50 minutes with ten partial stacks 8 in the stack station 3.

During the automatic feeding process from the supply stack 3 to the supply stack 5, the service person has sufficient time to load in succession a number of new partial stacks 8 into the empty cells of the conveyor 6 of the stack station 3. Because the total supply of the stack station 3 can be, in effect, emptied and filled into the stack station 5 without the need to load a new partial stack 8 after every cycle, the service person can concern him or herself with an additional machine serviced by him/her in order to load a corresponding stack station with additional partial stacks.

Although the invention is described and illustrated with reference to a preferred embodiment thereof, it is to be expressly understood that it is in no way limited to the disclosure of such preferred embodiment but is capable of numerous modifications within the scope of the appended claims.

I claim:

1. Apparatus for feeding a packaging machine with cardboard carton cut pieces or the like stored in stacks, comprising a first partial stack receiving stack station; a second partial stack receiving stack station; and a transport means operatively connecting both stack stations with each other on one side by horizontally successively moving said partial stacks from the first partial stack receiving station to the second partial stack receiving station;

the first stack station has a first conveyor, and the second stack station has a second conveyor, said first and second conveyors having contrarotating drives;

said first conveyor is arranged lateral and adjacent to the packaging machine on a mobile truck; and the second conveyor is arranged in the area of the packaging machine;

said packaging machine has a longitudinal axis, the transport means comprises a drive chassis having a mobile stack clamp arranged in the area of the first conveyor on the packaging side of the truck;

and wherein a lowering clamp is arranged in the area of the second conveyor on the opposite end from where the drive chassis is located;

the stack clamp first moves along said drive chassis transversely with respect to the longitudinal axis of the packaging machine, and subsequently moves along said drive chassis parallel to the longitudinal axis of said packaging machine.

* * * * *